United States Patent [19]

Hattori et al.

[11] 4,439,707

[45] Mar. 27, 1984

[54] SPARK PLUG WITH A WIDE DISCHARGE GAP

[75] Inventors: Tadashi Hattori, Okazaki; Hiroaki Yamaguchi, Anjo; Minoru Nishida; Minoru Ohta, both of Okazaki, all of Japan

[73] Assignee: Nippon Soken, Inc., Nishio, Japan

[21] Appl. No.: 285,333

[22] Filed: Jul. 22, 1981

[30] Foreign Application Priority Data

Jul. 23, 1980 [JP] Japan ..... 55-101776
Sep. 1, 1980 [JP] Japan ..... 55-121449

[51] Int. Cl.[3] ..... H01T 13/02

[52] U.S. Cl. ..... 313/130; 313/131 A; 313/137

[58] Field of Search ..... 313/137, 136, 138, 141, 313/130, 131 R, 131 A

[56] References Cited

U.S. PATENT DOCUMENTS

| | | | |
|---|---|---|---|
| 2,961,563 | 11/1960 | Peras | 313/131 R |
| 3,488,544 | 1/1970 | Burley et al. | 313/131 R |
| 3,883,762 | 5/1975 | Harris et al. | 313/131 A |
| 4,092,558 | 5/1978 | Yamada | 313/138 X |
| 4,337,408 | 6/1982 | Sone et al. | 313/130 |

FOREIGN PATENT DOCUMENTS

| | | | |
|---|---|---|---|
| 54-30333 | 3/1979 | Japan | 313/130 |

OTHER PUBLICATIONS

Segall, Development of Low Voltage Shunted Surface Gap Spark and Igniter Plugs . . . , WADC Technical Report 55-191, Jan. 1955, pp. X-9.

Anonymous, Research Disclosure, No. 206, Jun. 1981, pp. 209-210, 20613 Spark Plug.

*Primary Examiner*—David K. Moore
*Assistant Examiner*—K. Wieder
*Attorney, Agent, or Firm*—Cushman, Darby & Cushman

[57] ABSTRACT

A spark plug with a wide discharge gap includes an insulating layer formed on one or the other of its center and ground electrodes and disposed in the gap between the electrodes. The insulating layer includes an inner insulating layer of a material having a high dielectric constant and an outer insulating layer of a material having an excellent resistance to heat and high voltage, which surrounds the inner insulating layer, whereby ensuring a reduced discharge voltage, an improved ignition performance and improved heat resistance and durability.

14 Claims, 16 Drawing Figures

SPARK PLUG WITH A WIDE DISCHARGE GAP

BACKGROUND OF THE INVENTION

1. Field of the Invention

The present invention relates to spark plugs of the wide discharge gap type having an insulating layer which is inserted between the electrodes of the spark plug. More particularly, the present invention relates to such spark plugs in which the insulating layer comprises a layer of an insulating material having a high dielectric constant and a layer of an insulating material which satisfies a desired heat resisting and high voltage resisting properties, thus improving the discharge characteristic and the ignition performance by utilizing the polarization effect of the insulating layer.

2. Description of the Prior Art

Recently, there has been an increasing tendency toward using leaner air-fuel mixtures and higher compression ratios from the standpoint of exhaust emission control and fuel consumption. In either case of using leaner mixtures and using higher compression ratios, spark plugs are required to ensure an improved ignition performance, reduced electrode wear and lower discharge voltage. While a wider discharge gap is generally effective in improving the ignition performance, there is a disadvantage that the discharge voltage increases with an increase in the combustion chamber pressure of an internal combustion engine and consequently it is impossible to widen the discharge gap beyond a certain limit.

Prior art spark plugs of the type effectively utilizing the polarization effect to decrease the discharge voltage and widening the discharge gap to improve the ignition performance are disclosed in Japanese Patent Applications Laid-open No. 50-20146 and No. 52-145647. The spark plug disclosed in the latter Patent Application is constructed so that an insulator insulating a center electrode from a plug shell is extended into the gap between the center electrode and the ground electrode such that the two electrodes face each other through the insulator, and the relative positions of the center electrode, the insulator and the ground electrode are determined by the relative dimensions of a creeping gap, a small gap and the thickness of the insulator. In this case, it is only necessary to widen the creeping gap for improving the ignition performance and the thickness of the insulator must be decreased as far as possible to decrease the discharge voltage. However, if the thickness is decreased, the insulator will break down through it and the insulator will be damaged, with the result that the discharge spark does not pass through the creeping surface and the discharge distance is decreased thus deteriorating the ignition performance. On the other hand, it may be possible to use an insulating material having a greater dielectric constant for the same thickness so as to further decrease the discharge voltage. In this case, while the use of a material having a greater dielectric constant can certainly decrease the discharge voltage, it is difficult to select a suitable material which satisfies both the resistance to heat and the resistance to high voltage required for plug insulators.

SUMMARY OF THE INVENTION

It is an object of the present invention to provide a spark plug of the wide discharge gap type, which ensures a reduced discharge voltage and an improved ignition performance and has excellent heat resistance and durability.

To accomplish this object, in accordance with the present invention there is provided a spark plug in which one or the other of the center electrode and the ground electrode is provided with an insulating layer extended into the gap between the electrodes and the insulating layer comprises an inner insulating layer of a material having a high dielectric constant and an outer insulating layer, covering the high dielectric constant material layer, of a material having excellent resistance to heat and resistance to high voltage. The polarization effect of the layer of high dielectric constant material has the effect of reducing the discharge voltage, and the creeping discharge produced between the center electrode and the ground electrode through the intermediary of the insulating layers has the effect of providing a long-distance or wide discharge gap thereby improving the ignition performance. Also, the fact that the outer insulating layer is excellent in resistance to heat and resistance to high voltage has the effect of greatly immproving the heat resistance and durability of the spark plug.

DESCRIPTION OF THE PREFERRED EMBODIMENTS

Figure 1:
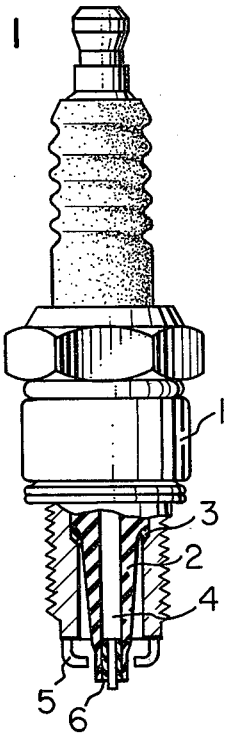
FIG. 1 is a partially sectional elevation showing a spark plug according to an embodiment of the present invention.
Figure 2:
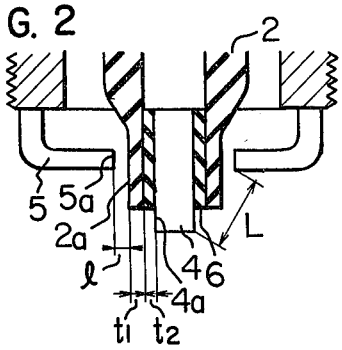
FIG. 2 is an enlarged sectional view showing the principal part of the spark plug of FIG. 1.

Referring to FIGS. 1 and 2 showing a first embodiment of the present invention, FIG. 2 is an enlarged sectional view showing the principal part of the first embodiment. In FIGS. 1 and 2, numeral 1 designates a metal plug shell, 2 an insulator made of $Al_2O_3$ and secured to the plug shell 1 by a packing 3, 4 a center electrode surrounded by the insulator 2 and electrically insulated from the plug shell 1, and 5 a pair of ground electrodes attached to the end face of the plug shell 1 and body grounded via the plug shell 1. Numeral 6 designates an inner insulating layer of a material having a high dielectric constant, e.g., $TiO_2$. The insulating layer 6 is previously sintered and attached by an adhesive so as to be held firmly between the center electrode 4 and the insulator 2 to form an inner insulating layer. Symbol l designates a small gap, $t_1$ the thickness of the outer insulator 2 of $Al_2O_3$, and $t_2$ the thickness of the inner insulating layer 6 of $TiO_2$. The overall insulator thickness represented by $t_1+t_2$ is preset so as to prevent occurrence of breakdown through the insulator 2 and the outer insulator thickness $t_1$ is preset in consideration of the durability, such as, $t_1=t_2=0.5$ mm.

With the spark plug constructed as described above, an application of a high voltage across the electrodes 4 and 5 produces a strong electric field at the shortest-distance portion or the small gap l between the electrodes 4 and 5. However, since the center electrode 4 is surrounded by the insulator 2 and the inner insulating layer 6, no discharge occurs at the small gap l and the insulator 2 and the inner insulator 6 are polarized. This polarization has the effect of ionizing the air-fuel mixture present in the small gap l with a relatively low voltage. This ionization gradually proceeds towards portions where the strength of the electric field diminishes and eventually the ionization of the mixture takes place among the forward end 5*a* of the ground electrode 5 and the surface 2*a* of the insulator 2 and the forward end 4*a* of the center electrode 4 so that a discharge occurs and a spark jumps from the forward end 5*a* of the ground electrode 5 to the forward end 4*a* of the center electrode 4 via the small gap l and the surface 2*a* of the insulator 2. In other words, a discharge takes place at a creeping discharge gap L.

In this case, since the insulating layer covering the center electrode 4 includes the inner insulating layer of $TiO_2$ having a high dielectric constant (dielectric constant of 80 to 90) and the outer insulating layer formed by the coventionally provided insulator 2 of $Al_2O_3$ (dielectric constant: 7 to 9), if the thickness of the insulating layers is fixed, the dielectric constant of the portions defining the small gap l becomes so high that the discharge voltage is decreased remarkably as compared with that provided by only the $Al_2O_3$ insulator as in the case of the prior art spark plugs. For example, as compared with the case employing only the $Al_2O_3$ insulator of 1.0 mm thick, the use of the insulating layer comprising the outer layer formed of the $Al_2O_3$ insulator of 0.5 mm thick and the $TiO_2$ inner layer of 0.5 mm thick lowers the discharge voltage by about 1 to 4 KV in terms of aerial discharge at a pressure of 2 to 8 $Kg/cm^2$.

Figure 3:
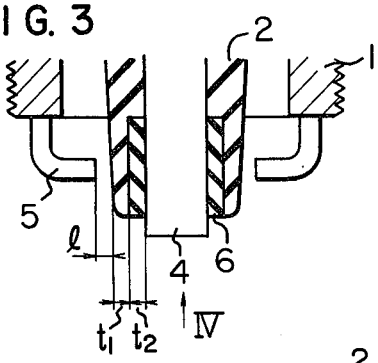
FIG. 3 is an enlarged sectional view showing the principal part of a spark plug according to another embodiment of the invention.
Figure 4:
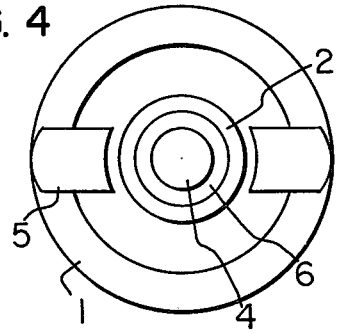
FIG. 4 is a plan view of the spark plug looking in the direction of the arrow IV in FIG. 3.

While, in the above embodiment, the forward end portion of the center electrode 4 is reduced in diameter and the cylindrical inner insulating layer 6 is provided on it, as shown in FIGS. 3 and 4, the inner side of the forward end portion of the insulator 2 may be cut off to form larger inner diameter portion into which the inner insulating layer 6 may be disposed without reducing the diameter of the forward end portion of the center electrode 4.

Figure 5:
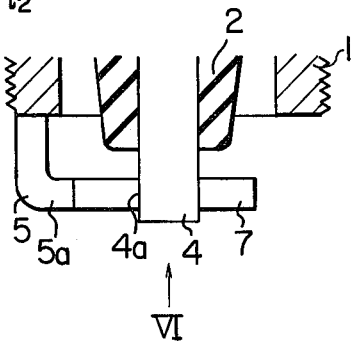
FIG. 5 is an enlarged sectional view showing the principal part of a spark plug according to still another embodiment of the invention.
Figure 6:
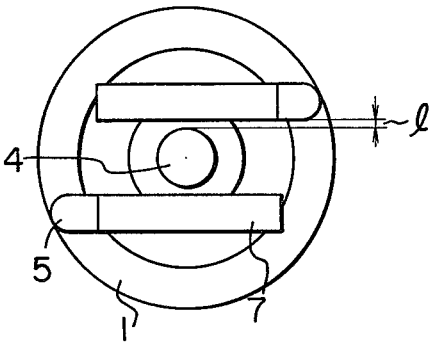
FIG. 6 is a plan view of the spark plug looking in the direction of the arrow IV in FIG. 5.
Figure 7:
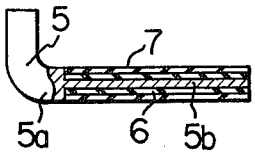
FIG. 7 is a sectional view showing the ground electrode of the spark plug shown in FIGS. 5 and 6.

FIGS. 5, 6 and 7 show another embodiment of the invention which differs from the above embodiments in that the required insulating layer is formed on the ground electrodes 5. FIG. 5 is a sectional view of the principal part and FIG. 6 is a plan view looked in the direction of the arrow VI in FIG. 5. FIG. 7 is a detail view of the ground electrode 5. In this embodiment, as shown in the figures, each of the ground electrodes 5 is in the form of a stepped and bent round bar having a reduced-diameter portion and its outer peripheral side faces the outer peripheral side of the center electrode 4. An inner insulating layer 6 of a high dielectric constant material such as $TiO_2$ is formed on the outer surface of a reduced-diameter portion 5*b* of the ground electrode 5 and an outer insulating layer 7 of a material having a resistance to heat and high voltage, such as $Al_2O_3$ is formed on the outer surface of the inner insulating layer 6. By virtue of the same mechanism as described in connection with FIGS. 1 and 2, a relatively low discharge voltage can cause a discharge between a bare portion 5*a* of the ground electrode 5 and the forward end 4*a* of the center electrode 4 via the surface of the outer insulating layer 7.

Figure 8:
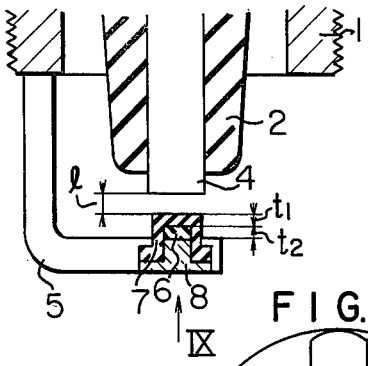
FIG. 8 is an enlarged sectional view showing the principal part of a spark plug according to still another embodiment of the invention.
Figure 9:
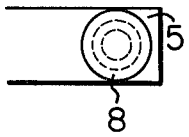
FIG. 9 is a partial plan view of the ground electrode looked in the direction of the arrow IX in FIG. 8.

FIGS. 8 and 9 show still another embodiment of the invention. In this embodiment, the single ground electrode 5 is provided with the insulating layer. More specifically, a stepped hole is formed in the ground electrode 5 at a position facing the center electrode 4 and the outer insulating layer 7 of a material having a resistance to heat and high voltage such as $Al_2O_3$, is formed into a collared cap shape and fitted into the hole. The inner insulating layer 6 of a high dielectric constant material such as $TiO_2$ is disposed fittedly within the outer insulating layer 7 and these layers are secured to the ground electrode 5 by means of a metallic keep plate 8. The keep plate 8 is made of the same material as the ground electrode 5 and secured to the latter by welding or adhesion. FIG. 9 is a plan view looked in the direction of the arrow IX in FIG. 8.

Figure 10:
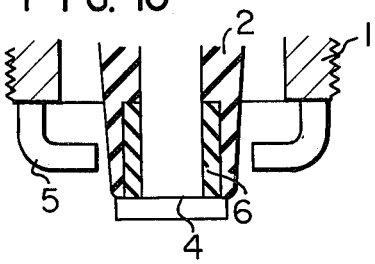
FIG. 10 is an enlarged sectional view showing the principal part of a spark plug according to still another embodiment of the invention.

FIG. 10 shows still another embodiment of the invention which differs from the embodiment shown in FIGS. 3 and 4 in that the forward end of the center electrode 4 is increased in diameter so as to protect the inner insulating layer 6. Since the purpose is to protect the inner insulating layer 6, the diameter of the forward end of the center electrode 4 is selected greater than the outside diameter of the inner insulating layer 6.

Figure 11:
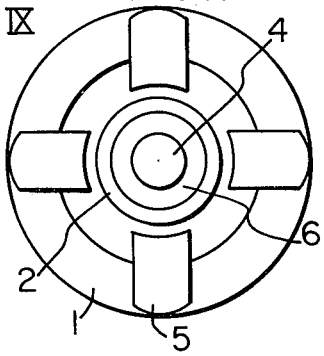
FIG. 11 is a plan view similar to FIG. 4, showing a modification of the spark plug shown in FIGS. 3 and 4.

While, in the embodiment of FIGS. 3 and 4 and the embodiment of FIGS. 5, 6 and 7, the two ground electrodes are used, generally the number of ground electrodes is not limited to two, and three or more ground electrodes may be used in case of need. Alternatively, a single annular ground electrode may be used. FIG. 11, which corresponds to FIG. 4, shows still another embodiment of the invention which differs from the embodiment of FIGS. 3 and 4 in that four ground electrodes are used.

Furthermore, while, in the above-described embodiments except the embodiment of FIGS. 8 and 9, the inner insulating layer 6 is prepared by a cylindrically shaped member which is secured to the electrode, the insulating layer 6 may be applied to the electrode by any of various methods including plasma spray coating, ion plating, sputtering, etc.

While, in the embodiments described above, the inner insulating layer of the high dielectric constant material and the outer insulating layer of the heat resisting and high voltage resisting material are arranged on the electrode separately, the same effect can be obtained by incorporating the layer of the high dielectric constant material in the layer of the heat resisting and high voltage resisting material. FIGS. 12 to 17 show still other embodiments of the invention having such an incorporating construction.

Figure 12:
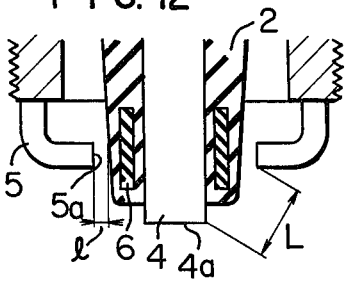
FIG. 12 is an enlarged sectional view showing the principal part of a spark plug according to still another embodiment of the invention.

In the embodiment of FIG. 12, a ring-shaped insulator 6 made of $TiO_2$, for example, is embedded in the forward end portion of the insulator 2 of $Al_2O_3$. The insulator 6 constituting the inner insulating layer in the embodiments of FIGS. 1 to 11 and can be built into the insulator 2 by preliminarily forming a ring of 0.1 to 0.5 mm thick, embedding it by molding in the insulator 2 and then sintering the insulator 2 including the insulator 6. Alternatively, the insulator 6 can be incorporated by forming a layer of $TiO_2$ on the presintered insulator 2 by means of coating, sputtering or the like and then applying to the surface of the $TiO_2$ layer an insulating material such as $Al_2O_3$ to the thickness of 0.1 to 0.5 mm by means of sputtering spray coating. That portion of the insulator 6 which is disposed outside the ring shaped insulator 2 constitutes the outer insulating layer described in conjuction with the embodiments of FIGS. 1 to 11 and protects the inner insulating layer 6. The insulating material for protecting the insulator 6 may be more or less porous, although the insulator should preferably be dense. In other words, what is required is to prevent a spark from contacting the insulator 6.

In accordance with this embodiment, the desired wide discharge gap is also provided, thus improving the ignition performance and reducing the discharge voltage. More specifically, when a high voltage is applied between the electrodes 4 and 5, a strong electric field is produced at the shortest distance portion or the gap l so that the insulating layers present in the shortest distance portion, particularly the high dielectric constant insulating material is polarized and this polarization has the effect of ionizing the air-fuel mixture at a relatively low voltage. The ionized zone gradually moves towards portions where the electric field decreases its strength and an ionization and hence a main discharge takes place between the end 5*a* of the ground electrode 5 and the end 4*a* of the center electrode 4. In other words, a discharge occurs at the creeping discharge gap L. The discharge voltage does not rise greatly although the creeping discharge gap L is relatively long. When the creeping discharge gap L was selected 2 mm (the distance of the gap l was 0.3 mm, the inner and outer diameters and thickness of the ring-shaped insulator 6 of $TiO_2$ were 3 mm, 4.5 to 5.5 mm and 0.2 to 0.5 mm, respectively, and the dielectric constant of the insulator was 80 to 90) the discharges produced in air at a pressure of 2 $Kg/cm^2$ to 8 $Kg/cm^2$ showed that the discharge voltage was reduced as much as 1 to 4 KV as compared with the prior art spark plug having a discharge gap with a distance of 1.1 mm. In particular, the spark plug of this embodiment was more advantageous over the prior art spark plugs as the pressure was increased. Phenomena of wear and deterioration of the spark plug was scarecely observed since the surface of the insulator 6 was protected by the insulator 2 and not exposed to sparks.

Figure 13:
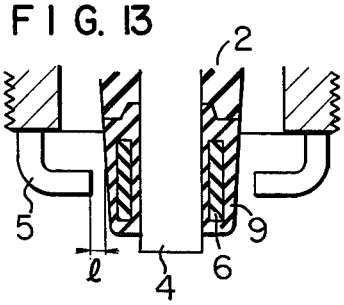
FIG. 13 is an enlarged sectional view showing the principal part of a spark plug according to still another embodiment of the invention.

FIG. 13 shows still another embodiment of the invention. In this embodiment, the ring-shaped high dielectric constant insulator 6 is preliminarily embedded in an insulator 9 made of $Al_2O_3$, for example, and then the insulator 9 is attached to the end of the insulator 2 by means of adhesion or the like. This embodiment is advantageous in that an insulating substance to be sintered under different conditions from the insulator 2 can be used as the material for the insulator 9.

Figure 14:
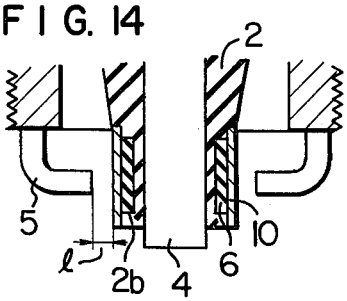
FIG. 14 is an enlarged sectional view showing the principal part of a spark plug according to still another embodiment of the invention.

FIG. 14 shows still another embodiment of the invention which differs from the embodiment of FIG. 12 in that the ring-shaped insulator or the inner insulating layer 6 is fitted in an annular recess 2*b* formed in the $Al_2O_3$ insulator 2 and an outer insulating layer 10 of $Al_2O_3$ or the like is applied onto the outer surface of the insulator 6 by means of sputtering, spray coating or the like.

Figure 15:
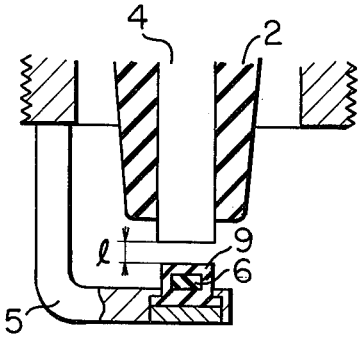
FIG. 15 is an enlarged sectional view showing the principal part of a spark plug according to still another embodiment of the invention.

FIG. 15 shows still another embodiment of the invention. In this embodiment an insulating member 11 is formed by embedding the high dielectric constant insulator 6 in an insulator 9 of $Al_2O_3$, for example. The insulating member 9 has a collared cylindrical shape and its forward end is projected from the upper side or surface of the ground electrode 5 to face the center electrode 4 and define a gap l as shown in the Figure. The method of mounting the insulating member 9 is practically the same as in the case of the embodiment shown in FIGS. 8 and 9 and the method comprises forming a stepped hole in the ground electrode 5 at a location facing the center electrode 4, fitting the insulating member 9 into the stepped hole and fastening the insulating member 9 to the ground electrode 5 by a metal keep plate. The metal keep plate is made from the same material as the ground electrode 5 and is attached to the ground electrode 5 by welding or adhesion.

Figure 16:
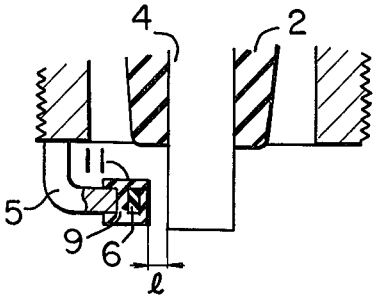
FIG. 16 is an enlarged sectional view showing the principal part of a spark plug according to still another embodiment of the invention.

FIG. 16 shows still another embodiment of the invention which differs from the embodiment of FIG. 15 in that the mounting position of the insulating member 11 is different, that is, the insulating member 11 is fitted on the forward end of the ground electrode 5. This embodiment has the advantage of reducing the cooling effect of the electrode on the flame core and improving the ignition performance. A hole adapted to engage with the forward end of the ground electrode 5, is formed in one end of the insulating member 11 which is opposite to the other end facing the center electrode 4 and the forward end of the ground electrode 5 is fitted and secured to the hole by means of adhesion or the like.

While, in the above-described embodiments, $TiO_2$ is used as the high dielectric constant material, a compound of $TiO_2$ with alkaline metal oxide (such as, $BaTiO_2$, $CaTiO_2$ or $SrTiO_2$) a piezoelectric ceramic (such as $PbTiO_2$, $PbZrO_3$ or PZT) or any of $NaNbO_3$, $KNbO_3$, $NaTaO_3$ and $KTaO_3$ may be used, and it is also possible to use any of these materials whose properties are modified by a suitable addition agent. In addition, any of other materials (such as $V_2O_3$, $MnO_2$, $Nb_2O_5$, CoO, $CrF_3$, $SiO_2$ and zircon titanate) and also any of mixtures of these materials may be used. Alternatively, a material produced by mixing SiC and $Al_2O_3$ or $TiO_2$ and $Al_2O_3$ and having an increased electric resistance value may be used.

We claim:

1. A spark plug with a wide discharge gap comprising:

a plug shell;

a cylindrical center electrode disposed along a spark plug axis;

an insulator of substantially cylindrical shape disposed so as to surround and electrically insulate said center electrode from said plug shell;

at least one ground electrode grounded through said plug shell and disposed to face and be spaced from said center electrode to form a gap therebetween; and an outer insulating layer comprising a material having a resistance to heat and high voltage formed on one of said electrodes so as to expose a portion of said one electrode, said outer insulating layer being extended into the gap between said electrodes to define a shortest gap between a surface of said insulating layer and the other of said electrodes, and further including an inner insulating layer of material having a high dielectric constant, said outer insulating layer being formed on said inner insulating layer so that said inner insulating layer is substantially covered thereby to substantially prevent said inner insulating layer from being exposed to sparks.

2. A spark plug according to claim 1, in which a forward end face of said ground electrode faces an outer peripheral side of said center electrode, wherein said center electrode includes an end portion smaller in outside diameter than the other portion of said center electrode, said end portion including a portion facing said forward end face of said ground electrode, said inner insulating layer is formed on an outer peripheral surface of said end portion excluding an outermost end portion thereof, and said cylindrical insulator is formed on said other portion of said center electrode and on said inner insulating layer, said outer insulating layer being formed by a portion of said cylindrical insulator disposed on said inner insulating layer.

3. A spark plug according to claim 1, in which a forward end face of said ground electrode faces an outer peripheral side of said center electrode, wherein said center electrode has a pole-like shape with a substantially uniform outside diameter and has an end portion including a portion facing said forward end face of said ground electrode, said inner insulating layer is formed on an outer peripheral surface of said end portion excluding an outermost end portion thereof, and said cylindrical insulator is formed on said center electrode and on said inner insulating layer, with having a portion corresponding to said end portion having an inside diameter substantially equal to an outside diameter of said inner insulating layer, said outer insulating layer being formed by a portion of said cylindrical insulator disposed on said inner insulating layer.

4. A spark plug according to claim 3, wherein said outermost end portion of said center electrode is greater in outside diameter than said inner insulating layer.

5. A spark plug according to claim 1, in which a side of said ground electrode faces an outer peripheral side of said center electrode, wherein said inner insulating layer is formed on a portion of said ground electrode including said portion facing said center electrode, and said outer insulating layer is formed on said inner insulating layer.

6. A spark plug according to claim 1, in which an upper side of said ground electrode faces an end face of said center electrode, wherein said ground electrode includes, at a position thereof facing said center electrode, insulating means including a cap-shaped first insulating member having an upper end portion projected from said upper side of said ground electrode such that an end face of said upper end portion faces said end face of said center electrode and a second insulating member inserted into an inner bottom portion of said first insulating member and forming said inner insulating layer, said outer insulating layer being formed by a part of said first insulating member including a portion positioned between said second insulating member and said center electrode.

7. A spark plug according to claim 1, in which a forward end face of said ground electrode faces an outer peripheral side of said center electrode, wherein said center electrode includes an end portion including a portion facing said ground electrode, said cylindrical insulator is formed to extend over said end portion excluding an outermost end portion thereof, and said inner insulating layer is formed by a ring-shaped insulating member embedded in said cylindrical insulator at a location corresponding to said end portion, said outer insulating layer being formed by a portion of said cylindrical insulator disposed on the outer surface of said ring-shaped insulating member.

8. A spark plug according to claim 1, in which a forward end face of said ground electrode faces an outer peripheral side of said center electrode, wherein said center electrode has an end portion including a portion facing said ground electrode, said cylindrical insulator is formed on said center electrode excluding said end portion, and a cylindrical insulating member is disposed on said end portion, said cylindrical insulating member including a ring-shaped insulating member forming said inner insulating layer embedded therein said outer insulating layer being formed by a portion of said cylindrical insulating member positioned on the outer side of said ring-shaped insulating member.

9. A spark plug according to claim 1, in which an end face of said ground electrode faces an outer peripheral side of said center electrode, wherein said center electrode has an end portion including a portion facing said ground electrode, said cylindrical insulator is disposed to extend over said end portion excluding an outermost end portion thereof, has an annular recess formed in an outer surface of said cylindrical insulator at a location corresponding to said end portion, and provided with a ring-shaped insulating member fitted in said recess, forming said inner insulating layer, and with an additional insulating layer covering at least a surface of said ring-shaped insulating member to form said outer insulating layer.

10. A spark plug according to claim 1, in which a forward end face of said ground electrode faces an outer peripheral side of said center electrode, wherein insulating means is formed on said forward end of said ground electrode, said insulating means comprising a first insulating member having a surface facing said center electrode and a second insulating member embedded in said first insulating member and forming said inner insulating layer, said second insulating member being positioned between said forward end face of said ground electrode and said outer peripheral side of said center electrode, said outer insulating layer being formed by a part of said first insulating member including a portion disposed between said second insulating member and said center electrode.

11. A spark plug according to claim 1, in which an upper side of said ground electrode faces an end face of said center electrode, wherein said ground electrode includes, at a position facing said center electrode, insulating means comprising a first insulating member having an upper end portion projected from said upper side of said ground electrode such that an end face of said upper end portion faces said end face of said center electrode and a second insulating member embedded in said first insulating member embedded in said first insulating member and forming said inner insulating layer, said outer insulating layer being formed by a part of said first insulating member including a portion disposed between said second insulating member and said center electrode.

12. A spark plug according to any one of claims 1 to 11, wherein the material of said outer insulating layer is $Al_2O_3$, and the material of said inner insulating layer is one selected from the group of $BaTiO_2$, $CaTiO_2$, $SrTiO_2$, $PbTiO_2$, $PbZrO_3$, PZT, $NaNbO_3$, $KNbO_3$, $NaTaO_3$ and $KTaO_3$ and mixtures containing the same as main components, $V_2O_3$, $MnO_2$, $Nb_2O_5$, CoO, $CrF_3$, $SiO_2$ and zircon titanate and mixtures thereof, a mixture of SiC and $Al_2O_3$ and a mixture of $TiO_2$ and $Al_2O_3$.

13. A spark plug as in claim 1 wherein substantially the whole surface of said inner insulating layer is covered.

14. A spark plug as in claim 1 wherein said inner insulating layer is embedded within said outer insulating layer.

* * * * *